US010246296B2

(12) United States Patent
Watanabe et al.

(10) Patent No.: US 10,246,296 B2
(45) Date of Patent: Apr. 2, 2019

(54) CONTROL CABLE GUIDE DEVICE FOR ELEVATOR

(71) Applicant: MITSUBISHI ELECTRIC CORPORATION, Chiyoda-ku (JP)

(72) Inventors: Seiji Watanabe, Chiyoda-ku (JP); Daisuke Nakazawa, Chiyoda-ku (JP); Daiki Fukui, Chiyoda-ku (JP); Masahiro Ishikawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 289 days.

(21) Appl. No.: 14/906,449

(22) PCT Filed: Aug. 14, 2013

(86) PCT No.: PCT/JP2013/071919

§ 371 (c)(1),
(2) Date: Jan. 20, 2016

(87) PCT Pub. No.: WO2015/022737

PCT Pub. Date: Feb. 19, 2015

(65) Prior Publication Data

US 2016/0159612 A1 Jun. 9, 2016

(51) Int. Cl.
*B66B 7/06* (2006.01)

(52) U.S. Cl.
CPC ..... *B66B 7/068* (2013.01); *B66B 7/064* (2013.01)

(58) Field of Classification Search
CPC ..... B66B 7/064; B66B 7/068
See application file for complete search history.

(56) References Cited

U.S. PATENT DOCUMENTS 1,822,153 A * 9/1931 Kinnard ..... B66B 7/064 187/413
2,017,372 A * 10/1935 Morrison ..... B66B 7/06 187/413

FOREIGN PATENT DOCUMENTS

| | | | |
|---|---|---|---|
| JP | 03-13478 A | | 1/1991 |
| JP | 2004115184 A | * | 4/2004 |
| JP | 2005-231794 A | | 9/2005 |
| JP | 2005-350214 A | | 12/2005 |
| JP | 2007-153588 A | | 6/2007 |
| JP | 2007-320729 | | 12/2007 |
| JP | 2009-166972 A | | 7/2009 |
| JP | 2010-83619 A | | 4/2010 |

OTHER PUBLICATIONS

International Search Report dated Nov. 5, 2013, in PCT/JP2013/071919 Filed Aug. 14, 2013.

* cited by examiner

*Primary Examiner* — Diem M Tran
(74) *Attorney, Agent, or Firm* — Xsensus, LLP

(57) ABSTRACT

A control cable guide device for an elevator, which is to be mounted to a control cable suspended between a middle portion of a hoistway and a lower portion of a car, the control cable having a curved portion formed at a lower end position of the control cable, the control cable guide device including an arm to be suspended on the control cable at a position below the car in a pivotable manner. The arm is configured to be pushed upward by the curved portion when the car is caused to travel to a lowermost position within a normal traveling range, to thereby shift to a cable receiving position for receiving the control cable while being partially projected from the car in a horizontal direction.

6 Claims, 8 Drawing Sheets

CONTROL CABLE GUIDE DEVICE FOR ELEVATOR

TECHNICAL FIELD

The present invention relates to a control cable guide device for an elevator, which is to be mounted to a control cable suspended between a middle portion of a hoistway and a lower portion of a car.

BACKGROUND ART

In an elevator constructed such that a control cable (traveling cable) is suspended between a hoistway wall and a car, and a curved portion is formed at a lower end position of the control cable, when the temperature inside a hoistway is increased, for example, in summer season, the flexural rigidity of the control cable is decreased to reduce the curvature radius of the curved portion of the control cable, thereby causing a risk in that the control cable is brought into contact with a side portion of the car. Particularly under a state in which the car is stopped on a lowermost floor, the distance in an up-and-down direction between the curved portion and the car becomes shorter. Therefore, when the curvature radius of the curved portion of the control cable is reduced, the control cable is liable to be in contact with the car.

Hitherto, in order to prevent the contact of the control cable with the car, there is proposed a control cable guide device for an elevator, which is constructed such that a plurality of rollers to be brought into contact with an inner peripheral surface of the curved portion are provided to a roller retaining unit for applying a load to the curved portion of the control cable, to thereby suppress the change in curvature radius of the curved portion (see Patent Literature 1).

CITATION LIST

Patent Literature

[PTL 1] JP 2010-83619 A

SUMMARY OF INVENTION

Technical Problem

In the related-art control cable guide device for an elevator, however, the respective rollers are caused to roll on the inner peripheral surface of the curved portion through the movement of the control cable along with the traveling of the car, thereby always generating noise due to the rolling of the respective rollers during the traveling of the car. Further, it is necessary to apply a load to the control cable, thereby upsizing the control cable guide device.

The present invention has been made to solve the problems as described above, and it is therefore an object of the present invention to provide a control cable guide device for an elevator, which is capable of suppressing noise during traveling of a car, and preventing contact of a control cable with the car with a simple structure.

Solution to Problem

According to one embodiment of the present invention, there is provided a control cable guide device for an elevator, which is to be mounted to a control cable suspended between a middle portion of a hoistway and a lower portion of a car, the control cable having a curved portion formed at a lower end position of the control cable, the control cable guide device including an arm to be suspended on the control cable at a position below the car in a pivotable manner, the arm being configured to be pushed upward by the curved portion when the car is caused to travel to a lowermost position within a normal traveling range, to thereby shift to a cable receiving position for receiving the control cable while being partially projected from the car in a horizontal direction.

Advantageous Effects of Invention

According to the control cable guide device for an elevator of the one embodiment of the present invention, even when the car is stopped at the lowermost position where the control cable is liable to be in contact with the car, the shift of the control cable in a direction of approaching the car can be inhibited by the arm, thereby being capable of preventing the contact of the control cable with the car with the simple structure. Further, the situation where noise is always generated during the traveling of the car can be avoided, thereby being capable of suppressing the noise during the traveling of the car.

DESCRIPTION OF EMBODIMENTS

Now, exemplary embodiments of the present invention are described with reference to the drawings.

First Embodiment

Figure 1:
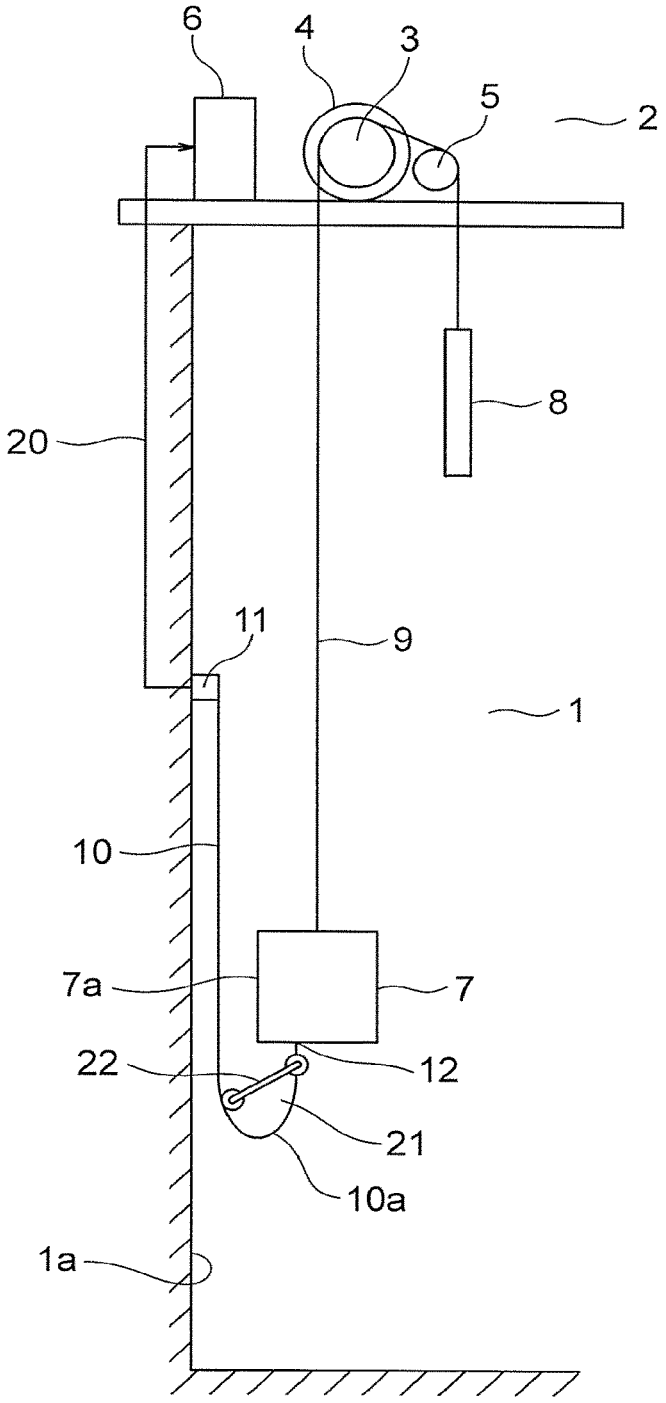
FIG. 1 is a structural view of an elevator according to a first embodiment of the present invention.

FIG. 1 is a structural view of an elevator according to a first embodiment of the present invention. In FIG. 1, a machine room 2 is provided above a hoistway 1. A hoisting machine (driving machine) 4 including a driving sheave 3, a deflector sheave 5 arranged away from the driving sheave 3, and a control panel (controller) 6 for controlling an operation of the elevator are provided in the machine room 2. In the hoistway 1, a car 7 and a counterweight 8 are provided so as to be movable in an up-and-down direction.

A suspending body 9 for suspending the car 7 and the counterweight 8 is looped around the driving sheave 3 and the deflector sheave 5. As the suspending body 9, for example, a rope, a belt, or the like is used. The driving sheave 3 is rotated by a driving force of a motor of the hoisting machine 4. Through the rotation of the driving sheave 3, the car 7 and the counterweight 8 are moved in the up-and-down direction inside the hoistway 1.

A control cable (traveling cable) 10 being a flexible elongated body, which is movable in accordance with the traveling of the car 7, is suspended to bridge a middle portion of the hoistway 1 and a lower portion of the car 7. At a lower end position of the control cable 10, a curved portion 10*a* is formed by curving the control cable 10 into a U-shape. In this example, the belt-like control cable 10 having a flat shape in cross section is suspended between the middle portion of the hoistway 1 and the lower portion of the car 7. The curved portion 10*a* is formed by curving the control cable 10 so that a thickness direction of the control cable 10 corresponds to a radial direction of the curved portion 10*a*.

At the middle portion of the hoistway 1, a hoistway cable suspending unit 11 is mounted onto an inner wall surface 1*a* of the hoistway 1. The control cable 10 is retained at a suspension point of the hoistway cable suspending unit 11 under a state of being spaced away from the inner wall surface 1*a*.

At the lower portion of the car 7 (in this example, a lower surface of the car 7), a car cable suspending unit 12 is mounted. The control cable 10 is retained at a suspension point of the car cable suspending unit 12. The end portion of the car 7, which is opposed to the inner wall surface 1*a* where the hoistway cable suspending unit 11 is mounted, is defined as a cable suspending-side car end portion 7*a*. Thus, the car cable suspending unit 12 is arranged at a position spaced away from the inner wall surface 1*a* in a horizontal direction beyond the cable suspending-side car end portion 7*a*. The control cable 10 is suspended to bridge the suspension points of the hoistway cable suspending unit 11 and the car cable suspending unit 12.

Electric wiring 20 is connected between the hoistway cable suspending unit 11 and the control panel 6. The car 7 and the control panel 6 are electrically connected to each other through the control cable 10 and the electric wiring 20. Control information, electric power, and the like are transmitted and received between the car 7 and the control panel 6 through the control cable 10 and the electric wiring 20.

The distance in the up-and-down direction from the curved portion 10*a* to the car 7 is changed in accordance with the traveling of the car 7 in the up-and-down direction. Specifically, the distance from the curved portion 10*a* to the car 7 becomes longer as the car 7 travels upward, whereas the distance from the curved portion 10*a* to the car 7 becomes shorter as the car 7 travels downward. Thus, when the car 7 is located on a lowermost floor (that is, when the car 7 is located at a lowermost position within a normal traveling range), the distance from the curved portion 10*a* to the car 7 becomes shortest, whereas when the car 7 is located on an uppermost floor (that is, when the car 7 is located at an uppermost position within the normal traveling range), the distance from the curved portion 10*a* to the car 7 becomes longest.

When the temperature around the control cable 10 is changed, the rigidity of the control cable 10 is changed. Specifically, when the temperature around the control cable 10 is increased, for example, in summer season, the rigidity of the control cable 10 is decreased, whereas when the temperature around the control cable 10 is decreased, for example, in winter season, the rigidity of the control cable 10 is increased. When the car 7 is located on the lowermost floor, the distance from the curved portion 10*a* to the car 7 becomes shortest. Therefore, when the curvature radius of the curved portion 10*a* is reduced, there is a risk in that a part of the control cable 10 extending downward from the hoistway cable suspending unit 11 is brought into contact with the cable suspending-side car end portion 7*a*. Thus, a control cable guide device 21 for preventing the contact of the control cable 10 with the car 7 is mounted to the control cable 10.

Figures 2A, 2B, 2C, 2D:
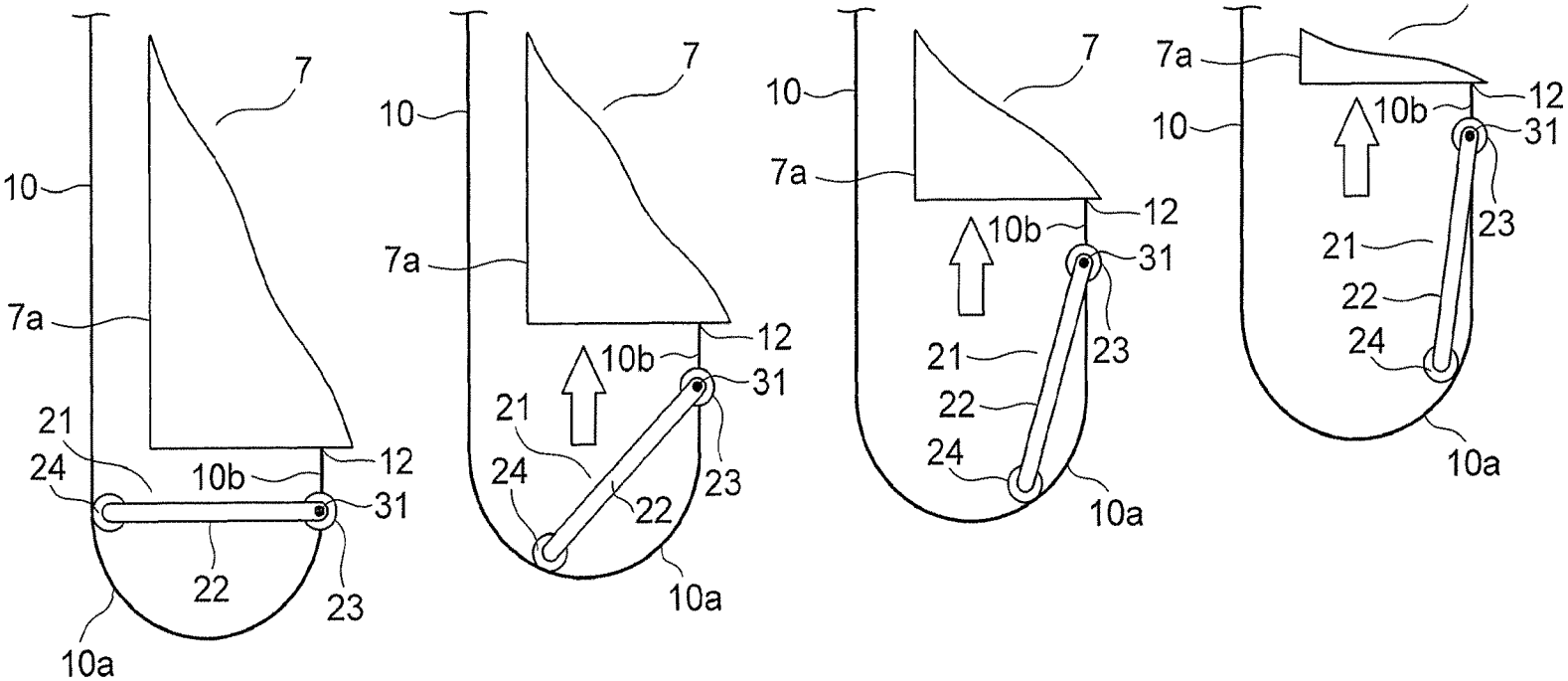
FIG. 2A to FIG. 2D are side views of states of a control cable guide device when a car of FIG. 1 travels upward from a lowermost floor.
Figure 3:
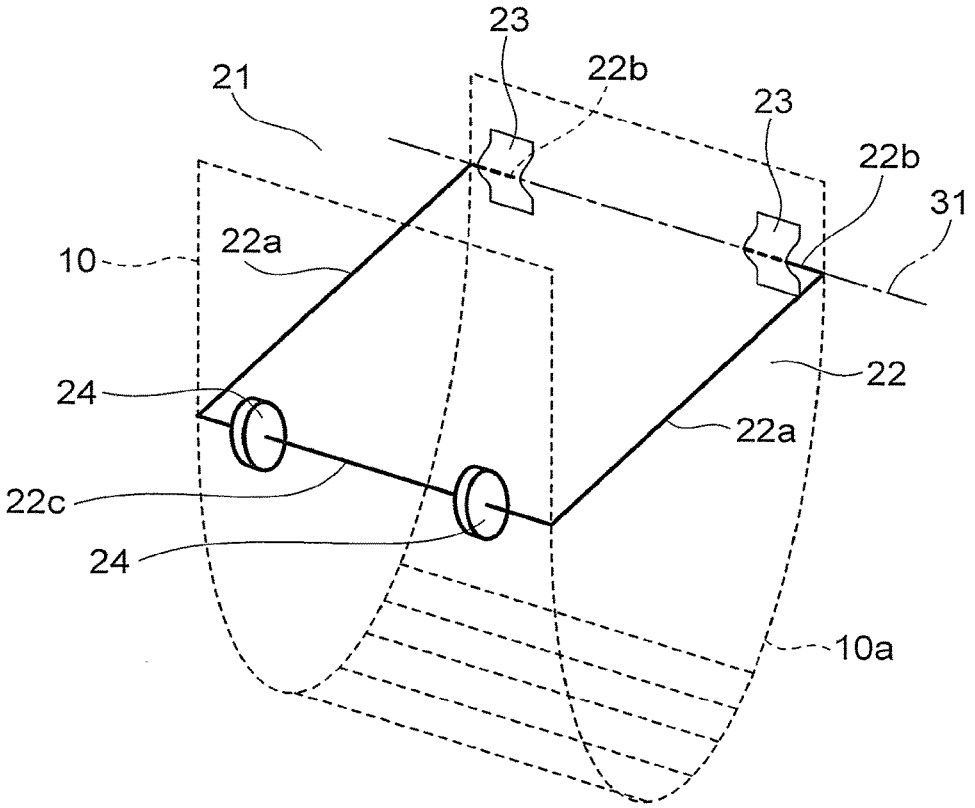
FIG. 3 is a perspective view of the control cable guide device of FIG. 2A to FIG. 2D.

FIG. 2A to FIG. 2D are side views of states of the control cable guide device 21 when the car 7 of FIG. 1 travels upward from the lowermost floor. FIG. 2A is a view of a state in which the car 7 reaches the lowermost floor, and FIG. 2B to FIG. 2D are views of states in which the car 7 is sequentially spaced away from the lowermost floor upward. Further, FIG. 3 is a perspective view of the control cable guide device 21 of FIG. 2A to FIG. 2D.

The control cable guide device 21 includes an arm 22 suspended on the control cable 10 at a position below the car 7 in a pivotable manner. The arm 22 is pivotable about an axis 31 perpendicular to an imaginary plane where the curved portion 10*a* exists (in this example, an axis 31 along a width direction of the belt-like control cable 10).

A pair of arm supports (arm supporting portions) 23 for supporting the arm 22 in a pivotable manner is mounted to the control cable 10. Each of the arm supports 23 is arranged on the axis 31. Further, as illustrated in FIG. 2A to FIG. 2D, each of the arm supports 23 is mounted to a curve avoiding portion 10*b* corresponding to a part of the control cable 10 extending downward from the car 7 (car cable suspending unit 12), at which the shape of the control cable 10 is maintained without the curve even when the car 7 travels within the normal traveling range.

The arm 22 is pivotable about the axis 31 relative to the control cable 10 under a state of being supported by the pair of arm supports 23. Further, as illustrated in FIG. 3, the arm 22 includes a pair of arm body portions 22*a* extending along a longitudinal direction of the arm 22, a pair of arm supporting-side end portions 22*b* formed at end portions of the respective arm body portions 22*a* on one side and mounted to the respective arm supports 23 in an individually pivotable manner, and a cable receiving-side end portion 22*c* being formed at end portions of the respective arm body portions 22*a* on the other side (end portions of the respective arm body portions 22*a*, which are spaced away from the arm supports 23) and connecting the pair of arm body portions 22*a*. In this example, each of the arm body portions 22*a*, the arm supporting-side end portions 22*b*, and the cable receiving-side end portion 22*c* has a bar-like shape, and the entire arm 22 has a substantially C-shape.

As illustrated in FIG. 1, the length of the arm 22 in its longitudinal direction is dimensioned to be larger than a horizontal distance between the cable suspending-side car end portion 7*a* and the car cable suspending unit 12 and smaller than a horizontal distance between the inner wall surface 1*a* and the car cable suspending unit 12. In this example, the length of the arm 22 in its longitudinal direction is dimensioned to be equal to a horizontal distance between the suspension points of the hoistway cable suspending unit 11 and the car cable suspending unit 12.

As illustrated in FIG. 2A to FIG. 2D and FIG. 3, the cable receiving-side end portion 22*c* is shifted along an arc formed about the axis 31 through the pivot of the arm 22 relative to the control cable 10. A plurality of (in this example, two) guide rollers 24, which are rollable on an inner peripheral surface of the curved portion 10*a*, are provided to the cable receiving-side end portion 22*c*.

When the guide rollers 24 are caused to roll on the inner peripheral surface of the curved portion 10*a* in accordance with the change in distance from the curved portion 10*a* to the car 7, the arm 22 is pivoted about the axis 31 while the cable receiving-side end portion 22*c* of the arm 22 is being guided along the inner peripheral surface of the curved portion 10*a*. Through the pivot of the arm 22 about the axis 31, the arm 22 is shifted between a cable receiving position where the cable receiving-side end portion 22*c* is oriented toward the inner wall surface 1*a* (FIG. 2A) and an accommodating position where the cable receiving-side end portion 22*c* is oriented downward with respect to the cable receiving position.

The arm 22 is pivoted in a direction of approaching the cable receiving position (FIG. 2A) while being pushed upward by the curved portion 10*a* that approaches the car 7 from the bottom, and reaches the cable receiving position (FIG. 2A) when the car 7 is caused to travel to the lowermost floor so that the distance from the curved portion 10*a* to the car 7 becomes shortest. When the curved portion 10*a* is spaced away from the guide rollers 24 downward, on the other hand, the upward pushing of the arm 22 by the curved portion 10*a* is avoided so that the position of the arm 22 is maintained at the accommodating position due to the self-weight of the arm 22.

When the arm 22 is located at the accommodating position, the longitudinal direction of the arm 22 is in a state of being close to a vertical direction, and hence the arm 22 is suspended on the control cable 10 under a state of extending substantially along the control cable 10. Thus, when the arm 22 is located at the accommodating position, the entire arm 22 is in a state of being spaced away from the inner wall surface 1*a* beyond the cable suspending-side car end portion 7*a*.

When the arm 22 is located at the cable receiving position, as illustrated in FIG. 2A, the arm 22 is in a horizontal state (including a substantially horizontal state). Further, when the arm 22 is located at the cable receiving position, in top view of the car 7, a part of the arm 22 (part including the cable receiving-side end portion 22*c* of the arm 22) is projected from the car 7. That is, the arm 22 located at the cable receiving position is in a horizontal state in which the part including the cable receiving-side end portion 22*c* is projected from the car 7 in the horizontal direction. Further, the arm 22 located at the cable receiving position receives the control cable 10 at the cable receiving-side end portion 22*c* to maintain the state in which the control cable 10 is spaced away from the car 7 in the horizontal direction, thereby preventing the contact of the control cable 10 with the car 7.

Figure 4:
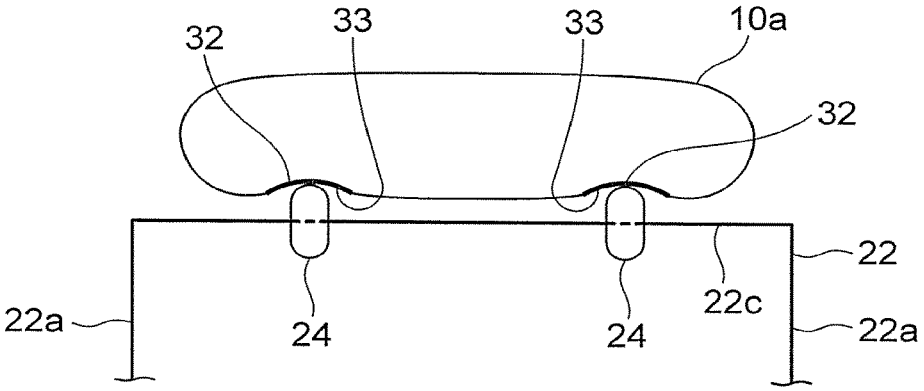
FIG. 4 is a top view of guide rollers and a curved portion of FIG. 3.

FIG. 4 is a top view of the guide rollers 24 and the curved portion 10*a* of FIG. 3. In the control cable 10, a plurality of (in this example, two) roller insertion grooves 32, into which the guide rollers 24 are inserted individually, are formed along a lengthwise direction of the control cable 10. Friction reducing sheets 33, with which the guide rollers 24 are brought into contact, are arranged on inner surfaces of the respective roller insertion grooves 32. In this example, the friction reducing sheets 33 are arranged on the inner surfaces of the respective roller insertion grooves 32 by applying and curing a liquid resin. The coefficient of friction between the guide roller 24 and the friction reducing sheet 33 is smaller than the coefficient of friction between the guide roller 24 and the inner surface of the roller insertion groove 32 (surface of the control cable 10). Thus, the guide roller 24 is caused to roll smoothly along the roller insertion groove 32 on the inner peripheral surface of the curved portion 10*a*. As a material for the friction reducing sheet 33, for example, Teflon (registered trademark) (polytetrafluoroethylene) is used. Note that, in this example, as illustrated in FIG. 4, the width dimension of the arm 22 (that is, the distance between the pair of arm body portions 22*a*) is larger than the width dimension of the control cable 10.

Next, an operation is described. When the car 7 is significantly spaced away from the lowermost floor upward and the curved portion 10*a* is spaced away from the guide rollers 24 downward, the arm 22 is shifted, due to the self-weight of the arm 22, to the accommodating position where the cable receiving-side end portion 22*c* is oriented downward. In this case, even when the car 7 is caused to travel in the up-and-down direction, the arm 22 is not pivoted relative to the control cable 10 so that the position of the arm 22 is maintained at the accommodating position.

When the car 7 is caused to travel downward and the guide rollers 24 reach the inner peripheral surface of the curved portion 10*a* that approaches the car 7 from the bottom, as illustrated in FIG. 2D, the guide rollers 24 are caused to roll on the inner peripheral surface of the curved portion 10*a*, and the arm 22 starts to pivot relative to the control cable 10 while the cable receiving-side end portion 22*c* is being guided along the curved portion 10*a*.

After that, when the car 7 further approaches the lowermost floor, the arm 22 is pushed upward by the curved portion 10*a* while the cable receiving-side end portion 22*c* is being guided along the inner peripheral surface of the curved portion 10*a* in an order of the illustrations of from FIG. 2C to FIG. 2B. Thus, the arm 22 is further pivoted relative to the control cable 10.

After that, when the car 7 reaches the lowermost floor so that the distance from the curved portion 10*a* to the car 7 becomes shortest, as illustrated in FIG. 2A, the arm 22 reaches the cable receiving position where the cable receiving-side end portion 22*c* is oriented toward the inner wall surface 1*a*. When the car 7 is located on the lowermost floor, the position of the arm 22 is maintained at the cable receiving position under the state in which the arm 22 is pushed upward by the curved portion 10*a*.

When the arm 22 is located at the cable receiving position, the arm 22 receives the control cable 10 at the cable receiving-side end portion 22*c* through intermediation of the guide rollers 24 to maintain the state in which the control cable 10 is spaced away from the car 7 in the horizontal direction, thereby preventing the contact of the control cable 10 with the car 7.

An operation to be carried out when the car 7 travels upward from the lowermost floor is reverse to the above-mentioned operation to be carried out when the car 7 travels toward the lowermost floor. Thus, when the car 7 travels upward from the lowermost floor, the arm 22 is pivoted toward the accommodating position in an order of the illustrations of from FIG. 2A to FIG. 2D while the curved portion 10*a* is being spaced away from the car 7 downward. After that, when the car 7 further travels upward, the curved portion 10*a* is completely spaced away from the guide rollers 24 downward, and the arm 22 is shifted to the accommodating position.

In the control cable guide device 21 for an elevator as described above, the arm 22 suspended on the control cable 10 at the position below the car 7 in a pivotable manner is pushed upward by the curved portion 10*a* of the control cable 10 through the traveling of the car 7 toward the lowermost floor, and is therefore shifted to the cable receiving position for receiving the control cable 10 while a part of the arm 22 is being projected from the car 7 in the horizontal direction. Thus, even when the car 7 is stopped on the lowermost floor where the control cable 10 is liable to be in contact with the car 7, the shift of the control cable 10 in a direction of approaching the car 7 can be inhibited by the arm 22, thereby being capable of preventing the contact of the control cable 10 with the car 7. Further, there is no need to employ the structure as in the related art, in which a load is applied to the control cable 10, thereby being capable of simplifying the structure of the control cable guide device 21 and reducing the burden on the control cable 10. Still further, the arm 22 is pivoted only when the car 7 travels near the lowermost floor, and hence the situation where noise is always generated during the traveling of the car 7 can be avoided, thereby being capable of suppressing the noise during the traveling of the car 7.

Further, the guide rollers 24, which are rollable on the inner peripheral surface of the curved portion 10*a*, are provided to the arm 22, and hence the arm 22 can smoothly be pushed upward by the curved portion 10*a*, thereby being capable of shifting the arm 22 to the cable receiving position more securely.

Further, in the control cable 10, the roller insertion grooves 32, into which the guide rollers 24 are inserted, are formed along the lengthwise direction of the control cable 10, thereby being capable of preventing disengagement of the arm 22 from the control cable 10 more securely.

Further, the friction reducing sheets 33, with which the guide rollers 24 are brought into contact, are arranged on the inner surfaces of the roller insertion grooves 32, and hence the coefficient of friction between the guide roller 24 and the friction reducing sheet 33 is smaller than the coefficient of friction between the guide roller 24 and the inner surface of the roller insertion groove 32. Thus, even when the guide rollers 24 become difficult to roll for some reasons, the guide rollers 24 can be slid on the friction reducing sheets 33, thereby being capable of shifting the arm 22 to the cable receiving position still more securely.

By the way, when the temperature around the control cable 10 is decreased, for example, in winter season so that the rigidity of the control cable 10 is increased, the curvature radius of the curved portion 10*a* is increased, thereby causing a risk in that the control cable 10 is brought into contact with the inner wall surface 1*a*. Particularly when the car 7 is located on the lowermost floor, the control cable 10 is liable to be in contact with the inner wall surface 1*a* due to the increase in curvature radius of the curved portion 10*a*. Thus, in order to prevent not only the contact of the control cable 10 with the car 7 but also the contact of the control cable 10 with the inner wall surface 1*a*, a cable regulating unit 34 for regulating the shift of the control cable 10 in a direction away from the cable receiving-side end portion 22*c* may be provided to the arm 22.

Figure 5:
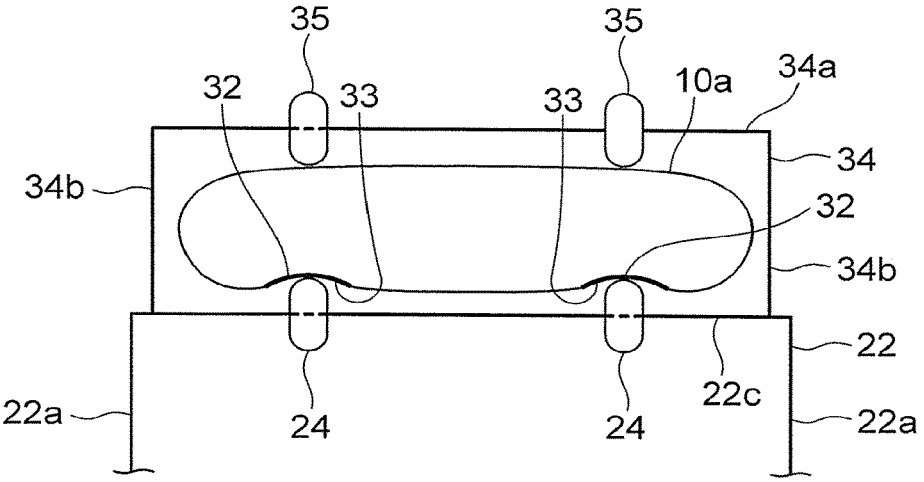
FIG. 5 is a main-part top view of another example of the control cable guide device for an elevator according to the first embodiment of the present invention.

That is, FIG. 5 is a main-part top view of another example of the control cable guide device for an elevator according to the first embodiment of the present invention. As illustrated in FIG. 5, the cable regulating unit 34 surrounding the control cable 10 is provided to the arm 22. The cable regulating unit 34 includes a bar-like wall-side arrangement portion 34*a* arranged in parallel to the cable receiving-side end portion 22*c* at a position spaced away from the cable receiving-side end portion 22*c* beyond the control cable 10, and a pair of bar-like connecting portions 34*b* connecting the wall-side arrangement portion 34*a* and the cable receiving-side end portion 22*c* at both sides of the control cable 10 in its width direction. A plurality of (in this example, two) guide rollers 35, which are rollable on an outer peripheral surface of the curved portion 10*a*, are provided to the wall-side arrangement portion 34*a*. The shift of the control cable 10 in the direction away from the cable receiving-side end portion 22*c* is prevented by receiving the control cable 10 at the wall-side arrangement portion 34*a*.

As described above, when the cable regulating unit 34 for regulating the shift of the control cable 10 in the direction away from the cable receiving-side end portion 22*c* is provided to the arm 22, not only the contact of the control cable 10 with the car 7 but also the contact of the control cable 10 with the inner wall surface 1*a* can be prevented.

Note that, in the example of FIG. 5, the wall-side arrangement portion 34*a* is connected to the arm 22 by the pair of connecting portions 34*b*. As long as the strength of the cable regulating unit 34 is secured, however, one of the pair of connecting portions 34*b* may be removed to retain the wall-side arrangement portion 34*a* on the arm 22 in a cantilever state using a single connecting portion 34*b* alone.

Further, in the example of FIG. 5, the guide rollers 35 are provided to the wall-side arrangement portion 34*a*, but the guide rollers 35 may be omitted as long as the wall-side arrangement portion 34*a* is slidable on the outer peripheral surface of the curved portion 10*a*.

Second Embodiment

Figure 6A:
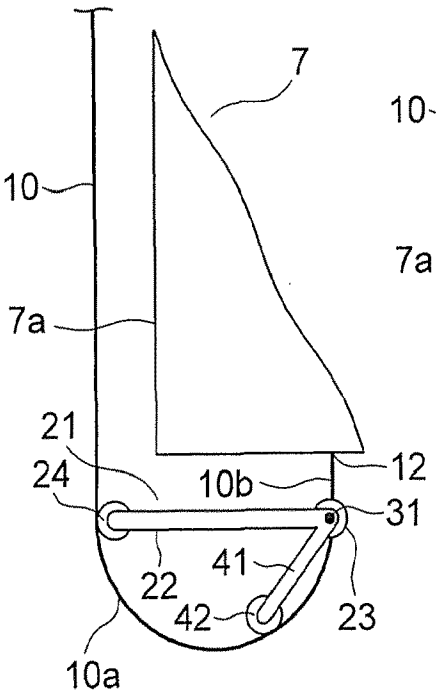
FIG. 6A to FIG. 6D are side views of states of a control cable guide device when the car travels upward from the lowermost floor according to a second embodiment of the present invention.
Figure 6B:
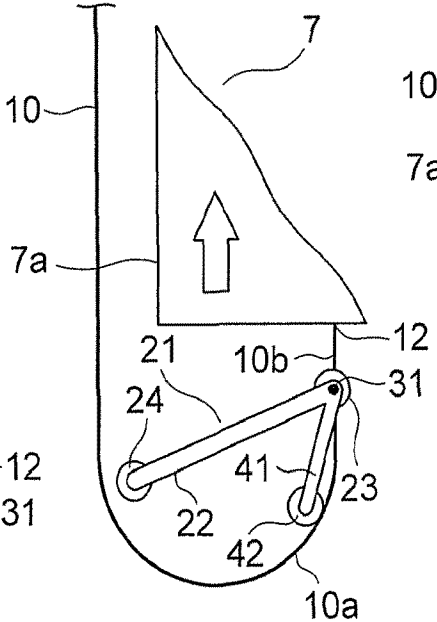
Figure 6C:
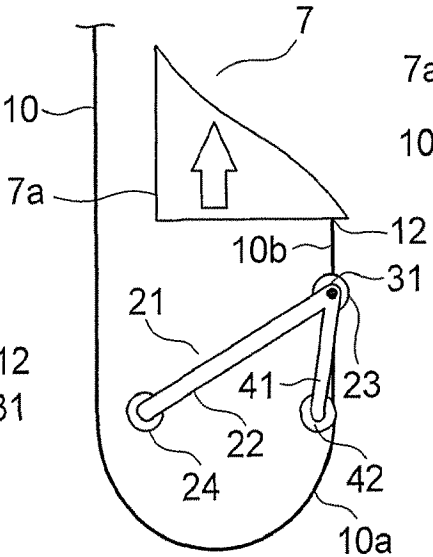
Figure 6D:
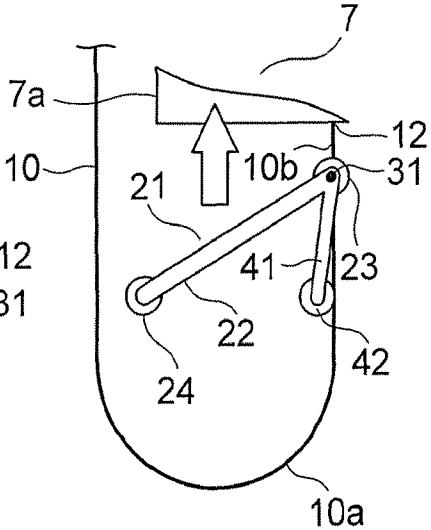
Figure 7:
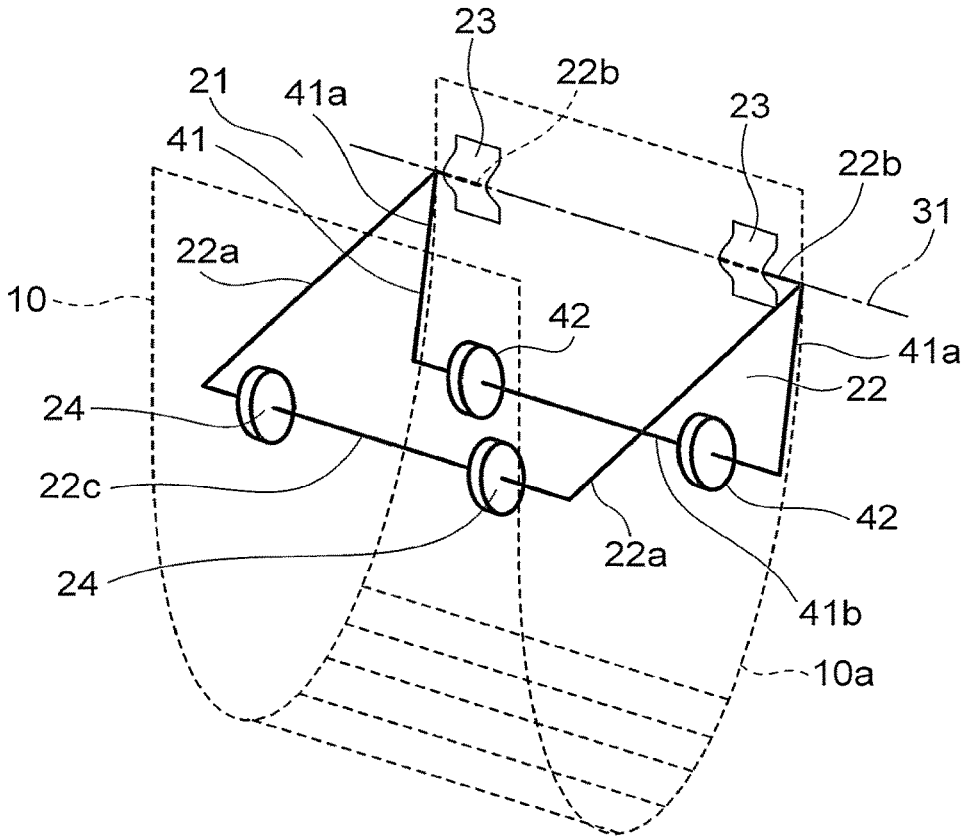
FIG. 7 is a perspective view of the control cable guide device of FIG. 6A to FIG. 6D.

FIG. 6A to FIG. 6D are side views of states of a control cable guide device 21 when the car 7 travels upward from the lowermost floor according to a second embodiment of the present invention. FIG. 6A is a view of a state in which the car 7 reaches the lowermost floor, and FIG. 6B to FIG. 6D are views of states in which the car 7 is sequentially spaced away from the lowermost floor upward. Further, FIG. 7 is a perspective view of the control cable guide device 21 of FIG. 6A to FIG. 6D. As illustrated in FIG. 6A to FIG. 6D and FIG. 7, the control cable guide device 21 further includes a branch member 41 projected from the arm 22, for pivoting the arm 22 while being guided along the curved portion 10*a*.

When the control cable guide device 21 is viewed along the axis 31, the arm 22 and the branch member 41 extend in different directions from the common axis 31, and the angle formed by the arm 22 and the branch member 41 is an acute angle. Further, the branch member 41 extends in a direction (downward direction) away from the car 7 beyond the arm 22. The length of the branch member 41 in its longitudinal direction is smaller than the length of the arm 22 in its longitudinal direction. The branch member 41 is fixed to the arm 22, and is pivoted about the axis 31 integrally with the arm 22.

As illustrated in FIG. 7, the branch member 41 includes a pair of bar-like branch body portions 41*a* fixed to the arm body portions 22*a* individually, and a branch receiving-side end portion 41*b* connecting end portions of the respective branch body portions, which are spaced away from the arm 22. Thus, the entire branch member 41 has a substantially C-shape.

A plurality of (in this example, two) guide rollers 42, which are rollable on the inner peripheral surface of the curved portion 10*a* under a state of being inserted into the roller insertion grooves 32, are provided to the branch receiving-side end portion 41*b* of the branch member 41. The branch receiving-side end portion 41*b* is guided along the curved portion 10*a* while the guide rollers 42 are rolling on the inner peripheral surface of the curved portion 10*a*, and thus the branch member 41 is pivoted about the axis 31 relative to the control cable 10. The arm 22 is pivoted about the axis 31 relative to the control cable 10 integrally with the branch member 41.

Through the pivot of the branch member 41 about the axis 31, the arm 22 is shifted between the cable receiving position where the cable receiving-side end portion 22*c* is oriented toward the inner wall surface 1*a* (FIG. 6A) and the accommodating position where the cable receiving-side end portion 22*c* is oriented downward with respect to the cable receiving position.

The arm 22 is pivoted in a direction of approaching the cable receiving position (FIG. 6A) while the branch member 41 is being pushed upward by the curved portion 10*a* that approaches the car 7 from the bottom, and reaches the cable receiving position (FIG. 6A) when the car 7 is caused to travel to the lowermost floor so that the distance from the curved portion 10*a* to the car 7 becomes shortest. When the curved portion 10*a* is spaced away from the guide rollers 42 downward, on the other hand, the upward pushing of the branch member 41 by the curved portion 10*a* is avoided so that the position of the arm 22 is maintained at the accommodating position due to the self-weight of each of the arm 22 and the branch member 41.

The cable receiving position of the arm 22 (FIG. 6A) is identical with the cable receiving position of the arm 22 of the first embodiment (FIG. 2A). When the arm 22 is located at the accommodating position, on the other hand, the arm 22 and the guide rollers 24 are retained under a state of being spaced away from the control cable 10 while the branch member 41 is being supported by the control cable 10. Thus, when the arm 22 is located at the accommodating position, the arm 22 is inclined with respect to the vertical direction under a state in which the cable receiving-side end portion 22*c* approaches the inner wall surface 1*a* as compared to the accommodating position of the first embodiment. The remaining structure is similar to that of the first embodiment.

In the control cable guide device 21 for an elevator as described above, the branch member 41 for pivoting the arm 22 while being guided along the curved portion 10*a* is projected from the arm 22, and hence the arm 22 located at the accommodating position can be inclined under a state of approaching the cable receiving position. Thus, the amount of pivot of the arm 22 from the accommodating position toward the cable receiving position can be reduced, thereby being capable of shifting the arm 22 to the cable receiving position still more securely.

Note that, in the example described above, when the arm 22 is viewed along the axis 31, the branch member 41 is projected from an end portion of the arm 22, which is positioned on the axis 31, but the branch member 41 may be projected from, for example, a middle portion of the arm 22 in its longitudinal direction.

Further, in the example described above, the guide rollers 42 are provided to the branch member 41, but the guide rollers 42 may be omitted as long as the branch receiving-side end portion 41*b* of the branch member 41 is slidable on the inner peripheral surface of the curved portion 10*a*.

Further, in the example described above, the entire branch member 41 has a substantially C-shape, but the shape is not limited thereto. For example, the entire branch member 41 may have a substantially I-shape along the longitudinal direction of the branch member 41, or have a plate shape along the longitudinal direction of the branch member 41.

Third Embodiment

Figure 8A:
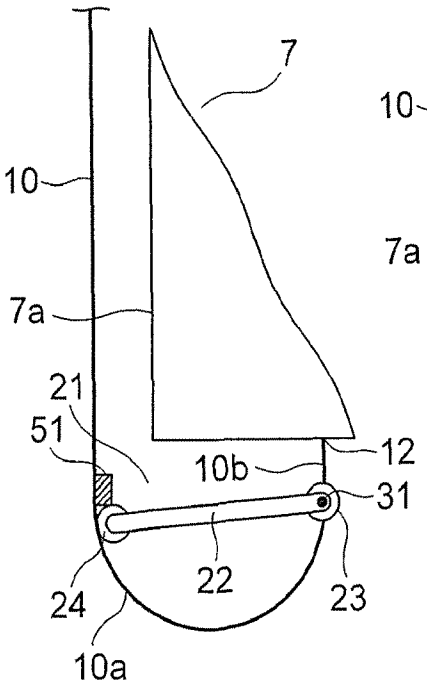
FIG. 8A to FIG. 8D are side views of states of a control cable guide device when the car travels upward from the lowermost floor according to a third embodiment of the present invention.
Figure 8B:
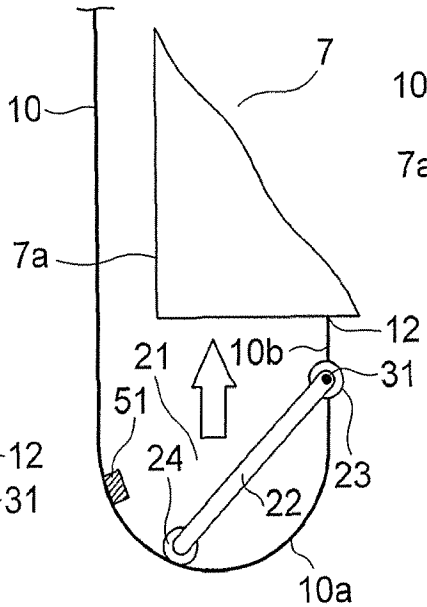
Figure 8C:
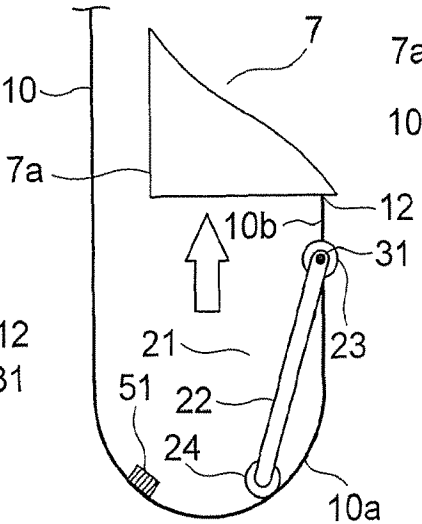
Figure 8D:
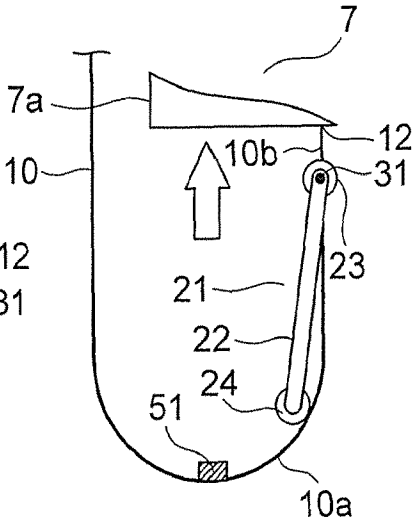

FIG. 8A to FIG. 8D are side views of states of a control cable guide device 21 when the car 7 travels upward from the lowermost floor according to a third embodiment of the present invention. FIG. 8A is a view of a state in which the car 7 reaches the lowermost floor, and FIG. 8B to FIG. 8D are views of states in which the car 7 is sequentially spaced away from the lowermost floor upward. The control cable guide device 21 further includes a permanent magnet 51 provided to the control cable 10.

The permanent magnet 51 is provided at a position on the control cable 10 in its lengthwise direction, which is spaced away from the car cable suspending unit 12 beyond the position where the arm supports 23 are mounted. Further, the length of the control cable 10 at a part between the arm support 23 and the permanent magnet 51 is larger than the length of the arm 22 in its longitudinal direction. In order to prevent interference with the guide rollers 24, the permanent magnet 51 is mounted to the control cable 10 at a part excluding the roller insertion grooves 32 along which the guide rollers 24 are caused to roll. In this example, the permanent magnet 51 is mounted to the control cable 10 with an adhesive.

The arm 22 is made of a magnetic material (for example, iron) to be subjected to a magnetic attraction force of the permanent magnet 51. When the car 7 is located on the lowermost floor, the permanent magnet 51 retains the cable receiving-side end portion 22*c* with the magnetic attraction force so that the position of the arm 22 is maintained at the cable receiving position. When the car 7 is caused to travel upward from the lowermost floor, the cable receiving-side end portion 22*c* is separated from the permanent magnet 51, and the arm 22 is shifted toward the accommodating position due to the self-weight of the arm 22 while the cable receiving-side end portion 22*c* is being guided along the curved portion 10*a*. The remaining structure is similar to that of the first embodiment.

In the control cable guide device 21 for an elevator as described above, the permanent magnet 51 for retaining the arm 22 with the magnetic attraction force when the car 7 is located on the lowermost floor, to thereby maintain the position of the arm 22 at the cable receiving position is provided to the control cable 10. Through the attraction of the arm 22 by the permanent magnet 51, the arm 22 can be shifted to the cable receiving position still more securely. Further, through the attraction of the cable receiving-side end portion 22*c* by the permanent magnet 51, the shift of the control cable 10 in the direction away from the cable receiving-side end portion 22*c* can be prevented. Thus, even when the rigidity of the control cable 10 is increased due to the decrease in temperature around the control cable 10, the increase in curvature radius of the curved portion 10*a* can be prevented by the magnetic attraction force of the permanent magnet 51. Accordingly, not only the contact of the control cable 10 with the car 7 but also the contact of the control cable 10 with the inner wall surface 1*a* can be prevented.

Note that, in the example described above, the arm 22 itself is made of the magnetic material to be subjected to the magnetic attraction force of the permanent magnet 51, but the magnetic material (for example, iron) may be fixed to a cable receiving-side end portion 22*c* of an arm 22 made of a non-magnetic material so that the magnetic material fixed to the arm 22 is attracted to the permanent magnet 51.

Fourth Embodiment

Figure 9A:
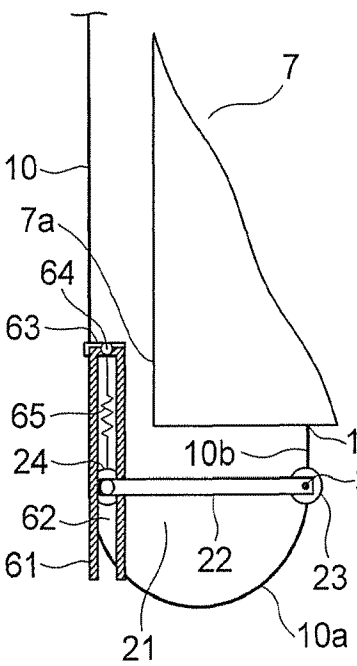
FIG. 9A to FIG. 9D are side views of states of a control cable guide device when the car travels upward from the lowermost floor according to a fourth embodiment of the present invention.
Figure 9B:
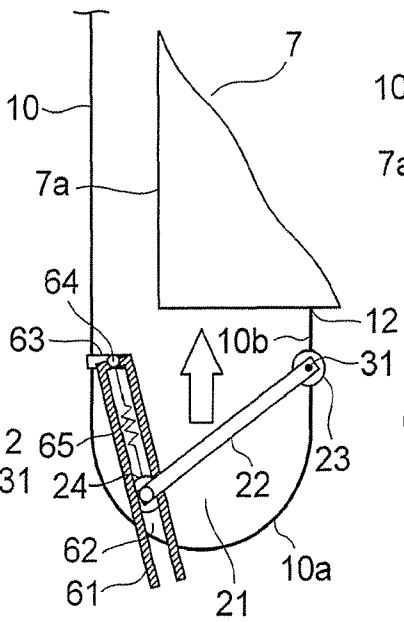
Figure 9C:
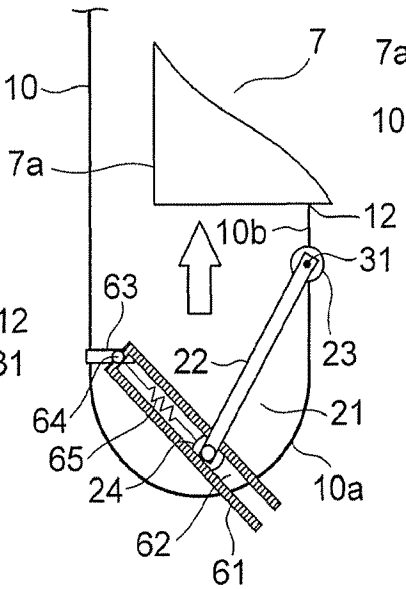
Figure 9D:
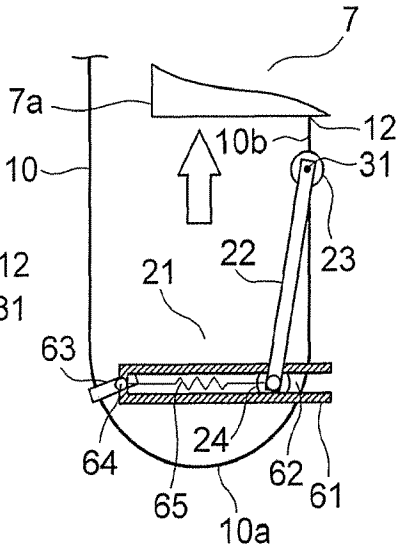

FIG. 9A to FIG. 9D are side views of states of a control cable guide device 21 when the car 7 travels upward from the lowermost floor according to a fourth embodiment of the present invention. FIG. 9A is a view of a state in which the car 7 reaches the lowermost floor, and FIG. 9B to FIG. 9D are views of states in which the car 7 is sequentially spaced away from the lowermost floor upward. The control cable guide device 21 further includes a link member 61 suspended on the control cable 10 in a pivotable manner.

The link member 61 is supported by a link support 63 mounted to the control cable 10. The link support 63 is provided at a position on the control cable 10 in its lengthwise direction, which is spaced away from the car cable suspending unit 12 beyond the position where the arm supports 23 are mounted. Further, the length of the control cable 10 at a part between the arm support 23 and the link support 63 is larger than the length of the arm 22 in its longitudinal direction, and is smaller than a total dimension of the lengths of the arm 22 and the link member 61 in their longitudinal directions.

A link pivot shaft 64 having an axis parallel to the axis 31 is provided to the link support 63. The link member 61 is pivotable about the axis of the link pivot shaft 64 relative to the control cable 10. One end portion of the link member 61 in its longitudinal direction is fixed to the link pivot shaft 64. The other end portion of the link member 61 in its longitudinal direction is shifted along an arc formed about the axis of the link pivot shaft 64 through the pivot of the link member 61 relative to the control cable 10. The link member 61 is pivoted on an imaginary plane defined on an outer side of the control cable 10 in its width direction (outer side of the control cable 10 in a direction of the axis of the link pivot shaft 64). In this example, the link member 61 is provided only on one side of the control cable 10 in its width direction.

A slit 62 extending along the longitudinal direction of the link member 61 is formed in the link member 61. The arm 22 is coupled to the link member 61 under a state in which the cable receiving-side end portion 22*c* is inserted through the slit 62. The cable receiving-side end portion 22*c* is slidable along the slit 62. A spring 65 being an elastic body connected between the one end portion of the link member 61 in its longitudinal direction and the cable receiving-side end portion 22*c* is arranged inside the slit 62. The cable receiving-side end portion 22*c* is supported by the spring 65 in the longitudinal direction of the link member 61.

The arm 22 is pivoted about the axis 31 relative to the control cable 10 in accordance with the change in distance from the curved portion 10*a* to the car 7 while the cable receiving-side end portion 22*c* is being supported by the spring 65. When the position of the link support 63 with respect to the arm supports 23 is changed in accordance with the change in distance from the curved portion 10*a* to the car 7, the link member 61 is pivoted about the axis of the link pivot shaft 64 relative to the control cable 10 while being slid along the slit 62 relative to the cable receiving-side end portion 22*c*. The spring 65 is extended or contracted when the link member 61 is slid along the slit 62 relative to the cable receiving-side end portion 22*c*. Thus, the spring 65 is adaptable to a change in distance between the axis 31 and the link pivot shaft 64.

When the arm 22 is located at the cable receiving position, as illustrated in FIG. 9A, the link member 61 is suspended downward from the link support 63. At this time, the link member 61 receives the cable receiving-side end portion 22*c* with the spring 65 arranged inside the slit 62. When the arm 22 is located at the cable receiving position, the arm 22 is pushed upward by the curved portion 10*a* and supported by the spring 65 arranged inside the slit 62 so that the position of the arm 22 is maintained at the cable receiving position. At this time, the spring 65 is kept in a state of being extended because the arm 22 is supported by the spring 65.

When the car 7 travels upward from the lowermost floor, the curved portion 10*a* is spaced away from the car 7 downward so that, in an order of the illustrations of from FIG. 9A to FIG. 9D, the arm 22 is pivoted from the cable receiving position toward the accommodating position while the cable receiving-side end portion 22*c* is being guided along the curved portion 10*a*, and the link member is slid along the elongate hole 62 relative to the cable receiving-side end portion 22*c*. The arm 22 reaches the accommodating position when the car 7 further travels upward under the state illustrated in FIG. 9D.

When the car 7 further travels upward after the arm 22 reaches the accommodating position, the link support 63 is moved toward a position below the arm supports 23 while the spring 65 is being further extended along with the downward shift of the curved portion 10*a* relative to the car 7. Thus, the link member 61 and the arm 22 are arranged substantially on a vertical line with the link member 61 being kept coupled to the cable receiving-side end portion 22*c* of the arm 22 in a slidable manner. The remaining structure is similar to that of the first embodiment.

In the control cable guide device 21 for an elevator as described above, the link member 61 having the slit 62 along which the cable receiving-side end portion 22*c* of the arm 22 is slidable is suspended on the control cable 10 in a pivotable manner. When the car 7 is located on the lowermost floor, the link member 61 receives the arm 22 with the spring 65 arranged inside the slit 62, thereby being capable of shifting the arm 22 to the cable receiving position still more securely, and maintaining the position of the arm 22 at the cable receiving position still more securely under a state in which the arm 22 is received through the extension of the spring 65 arranged inside the slit 62 of the link member 61.

Note that, in the example described above, the link member 61 is provided only on one side of the control cable 10 in its width direction, but the link members 61 may be provided on both sides of the control cable 10 in its width direction, respectively.

Further, in each of the embodiments described above, the guide rollers 24 are provided to the arm 22, but the guide rollers 24 may be omitted as long as the cable receiving-side end portion 22*c* of the arm 22 is slidable on the inner peripheral surface of the curved portion 10*a*.

Further, in each of the embodiments described above, the roller insertion grooves 32 are formed in the control cable 10, but the roller insertion grooves 32 need not be formed in the control cable 10.

Further, in each of the embodiments described above, the control cable 10 has a belt-like shape with a flat shape in cross section, but the shape is not limited to. For example, the control cable 10 may have a circular shape in cross section.

Further, in each of the embodiments described above, the entire arm 22 has a substantially C-shape, but the shape of the entire arm 22 is not limited thereto. For example, the entire arm 22 may have a substantially I-shape along the longitudinal direction of the arm 22, or have a plate shape along the longitudinal direction of the arm 22.

Further, the permanent magnet 51 according to the third embodiment may be applied to the second or fourth embodiment, or the link member 61 according to the fourth embodiment may be applied to the second or third embodiment. Further, the cable regulating unit 34 illustrated in FIG. 5 may be applied to the third embodiment.

The invention claimed is:

1. A control cable guide device for an elevator, which is to be mounted to a control cable, the control cable extending from a middle portion of a hoistway, along a cable suspending side surface of a car, and to a lower portion of the car, the control cable having a curved portion formed at a lower end position of the control cable, the control cable guide device comprising:

an arm to be suspended on the control cable at a position below the car in a pivotable manner, the arm being configured to be pushed upward by the curved portion when the car is caused to travel to a lowermost position within a normal traveling range, to thereby shift to a cable receiving position for receiving the control cable, wherein when the arm is in the cable receiving position, the arm projects to the cable suspending side beyond a plane formed by the side surface of the car as viewed from a top of the car.

2. The control cable guide device for an elevator according to claim 1, further comprising a branch member projected from the arm, for pivoting the arm while being guided along the curved portion, wherein, when the car is caused to travel to the lowermost position, the arm is pushed upward by the curved portion while the branch member is being guided along the curved portion, to thereby shift to the cable receiving position.

3. The control cable guide device for an elevator according to claim 1, further comprising a magnet provided to the control cable, for retaining the arm with a magnetic attraction force when the car is located at the lowermost position, to thereby maintain a position of the arm at the cable receiving position.

4. The control cable guide device for an elevator according to claim 3, wherein the arm comprises a cable regulating unit for regulating a shift of the control cable in a direction away from a cable receiving-side end portion, which is a part of the arm for receiving the control cable.

5. The control cable guide device for an elevator according to claim 1, further comprising a link member suspended on the control cable in a pivotable manner, the link member having a slit along which the arm is slidable, wherein, when the car is located at the lowermost position, the link member receives the arm with a spring arranged inside the slit, to thereby maintain the position of the arm at the cable receiving position.

6. The control cable guide device for an elevator according to claim 1, wherein the arm comprises a cable regulating unit for regulating a shift of the control cable in a direction away from a cable receiving-side end portion, which is a part of the arm for receiving the control cable.

* * * * *